US007665327B2

(12) United States Patent
Tunzi

(10) Patent No.: US 7,665,327 B2
(45) Date of Patent: Feb. 23, 2010

(54) CHILLED FOOD STORAGE AREA FOR REFRIGERATED APPLIANCE

(75) Inventor: Scott T. Tunzi, Madison, WI (US)

(73) Assignee: Sub-Zero, Inc., Madison, WI (US)

( * ) Notice: Subject to any disclaimer, the term of this patent is extended or adjusted under 35 U.S.C. 154(b) by 353 days.

(21) Appl. No.: 11/654,218

(22) Filed: Jan. 17, 2007

(65) Prior Publication Data

US 2008/0168792 A1 Jul. 17, 2008

(51) Int. Cl.
*F25D 11/02* (2006.01)
*F25D 17/06* (2006.01)

(52) U.S. Cl. ..... 62/441; 62/408; 62/419; 62/426

(58) Field of Classification Search ..... 62/441–442, 62/408, 419

See application file for complete search history.

(56) References Cited

U.S. PATENT DOCUMENTS

| | | | | |
|---|---|---|---|---|
| 1,693,387 | A | 11/1928 | Juneau et al. | |
| 1,774,312 | A | 8/1930 | Braeutigam | |
| 2,246,342 | A | 6/1941 | Brown | |
| 2,404,851 | A | 7/1946 | Knowles et al. | |
| 3,169,383 | A * | 2/1965 | Morton et al. | 62/414 |
| 3,364,694 | A | 1/1968 | Cohen et al. | |
| 3,600,905 | A | 8/1971 | Dymek et al. | |
| 3,638,717 | A | 2/1972 | Harbour et al. | |
| 3,680,941 | A | 8/1972 | Shanks | |
| 4,173,378 | A | 11/1979 | Hanson et al. | |
| 4,732,014 | A | 3/1988 | Frohbieter | |
| 4,751,826 | A | 6/1988 | Kawahara et al. | |
| 4,788,832 | A | 12/1988 | Aoki et al. | |
| 4,850,206 | A | 7/1989 | Larsen | |
| 4,867,512 | A | 9/1989 | Wilkins et al. | |
| 4,870,836 | A | 10/1989 | Pink | |
| 5,040,856 | A | 8/1991 | Wilkins et al. | |
| 5,095,717 | A | 3/1992 | Germi | |
| RE34,377 | E | 9/1993 | Wilkins et al. | |
| 5,287,252 | A | 2/1994 | Caruso | |
| 5,357,769 | A | 10/1994 | Crabtree et al. | |
| 5,392,615 | A | 2/1995 | Lim | |
| 5,641,217 | A | 6/1997 | Caruso et al. | |
| 5,918,480 | A | 7/1999 | Nagata et al. | |
| 6,170,276 | B1 | 1/2001 | Mandel et al. | |
| 6,223,553 | B1 | 5/2001 | Albert et al. | |
| 6,343,477 | B1 | 2/2002 | Mandel et al. | |
| 6,463,752 | B2 | 10/2002 | Mandel et al. | |
| 6,497,113 | B1 | 12/2002 | Yamada et al. | |
| 6,612,116 | B2 * | 9/2003 | Fu et al. | 62/3.6 |
| 6,655,169 | B2 * | 12/2003 | Tupis et al. | 62/417 |
| 6,722,142 | B1 | 4/2004 | Pagel | |
| 7,204,095 | B2 | 4/2007 | Jeong et al. | |

(Continued)

OTHER PUBLICATIONS

Sub-Zero Design Guide, 3758546 Rev-B, Sep. 2006, 84 pages.

*Primary Examiner*—Frantz F Jules
*Assistant Examiner*—Cassey Bauer
(74) *Attorney, Agent, or Firm*—Foley & Lardner LLP

(57) ABSTRACT

An appliance with a separately chilled storage area is disclosed. The appliance comprises a refrigerated compartment; a refrigeration system for cooling air; an air circulation system for circulating the cooled air about the refrigerated compartment; and a secondary air circulation system for circulating a portion of the cooled air in the storage assembly.

21 Claims, 6 Drawing Sheets

U.S. PATENT DOCUMENTS

2002/0023454 A1* 2/2002 Watanabe et al. ..... 62/285
2007/0093102 A1 4/2007 Park et al.
2007/0163289 A1 7/2007 Hahm et al.
2007/0163290 A1 7/2007 Shin et al.
2007/0163291 A1 7/2007 Kim et al.
2008/0156029 A1* 7/2008 Ritchie et al. ..... 62/408
2008/0245079 A1* 10/2008 Lim et al. ..... 62/66

* cited by examiner

CHILLED FOOD STORAGE AREA FOR REFRIGERATED APPLIANCE

BACKGROUND

The present invention relates to a chilled food storage area for a refrigerated appliance. The present invention further relates to a food storage area that is chilled by cold humid air taken from near the evaporator.

Appliances having one or more refrigerated compartments (e.g., refrigerator compartment for fresh foods, freezer compartment for frozen foods, etc.) are generally known. It is also generally known to provide an additional chilled food storage area (e.g., "crispers") to such appliances. Known chilled food storage areas are typically located in a refrigerator compartment (for fresh foods) and receive chilled air from a freezer compartment so that the food storage area is maintained at a temperature less than the rest of the refrigerator compartment. However, such chilled food storage areas have several disadvantages including the use of dry air from the freezer to cool fresh foods such as vegetables, or use of complex multi-housing arrangements intended to keep the dry freezer air from directly contacting the food within the food storage area. Also, known refrigerators typically provide the food storage drawers at the bottom of the refrigerator compartment, and typically introduce the chilled air at the top of the refrigerator compartment. In such known arrangements, the air that ultimately cools the crisper drawers has an increased in temperature from when the evaporate first cooled it.

Accordingly, it would be advantageous to provide an appliance that has separate refrigeration and air circulation systems for the refrigerator and freezer compartments so that a food storage area can be provided chilled humid air rather than dry chilled air. It would also be advantageous to provide a chilled food storage area that receives air directly from the evaporator so that it was cooler than air that it would otherwise receive from the main air supply duct. It would be desirable to provide a chilled food storage area for refrigerator having one or more of these or other advantageous features. To provide an inexpensive, reliable, and widely adaptable chilled food storage area that avoids the above-referenced and other problems would represent a significant advance in the art.

SUMMARY

The present invention relates to an appliance comprising a first compartment; a refrigeration system for cooling air; an air circulation system for circulating the cooled air about the first compartment; a storage assembly located in the first compartment; and a secondary air circulation system for circulating a portion of the cooled air in the storage assembly.

The present invention also relates to an appliance comprising a refrigerated compartment; a main air duct extending along at least a portion of the refrigerated compartment; an evaporator to cool air in the main air duct; a first fan coupled to the main air duct and configured to circulate between the main air duct and the refrigerated compartment; a storage assembly located in the refrigerated compartment; and a secondary duct coupled to the main duct and configured to allow air flow between the main duct and the storage assembly. A portion of the air cooled by the evaporator is supplied to the storage assembly through the secondary duct and the remainder of the air cooled by the evaporator is supplied to the refrigerated compartment by the fan.

The present invention further relates to an appliance comprising a refrigerated compartment; a first drawer located in the refrigerated compartment; a second drawer located in the refrigerated compartment below the first drawer; a main air duct extending substantially the length of the refrigerated compartment; an evaporator to cool air in the main air duct located at least partially in the main air duct and adjacent the first drawer and second drawer; and a secondary air duct in communication with the chilled air near the evaporator in the main duct. A portion of the chilled air is supplied directly to the refrigerated compartment near the first drawer and the second drawer through the secondary duct and the remainder of the air cooled by the evaporator is supplied to the refrigerated compartment away from the first drawer.

The present invention further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the claims which follow.

Figure 1:
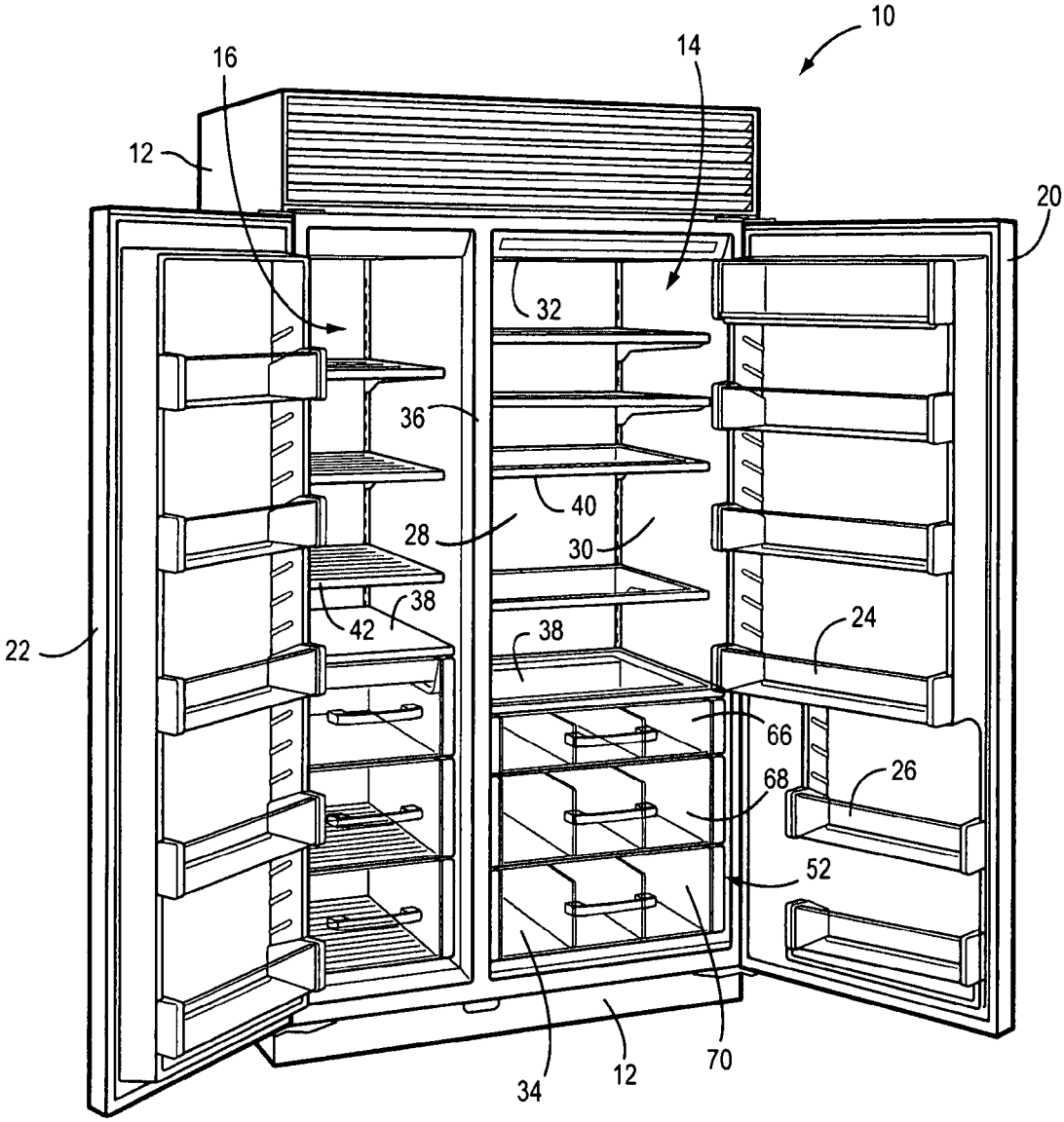
FIG. 1 is perspective view of a refrigerator according to a preferred embodiment.

Before explaining a number preferred, exemplary, and alternative embodiments of the invention in detail it is to be understood that the invention is not limited to the details of construction and the arrangement of the components set forth in the following description or illustrated in the drawings. The invention is capable of other embodiments or being practiced or carried out in various ways. It is also to be understood that the phraseology and terminology employed herein is for the purpose of description and should not be regarded as limiting.

DETAILED DESCRIPTION

Figure 2:
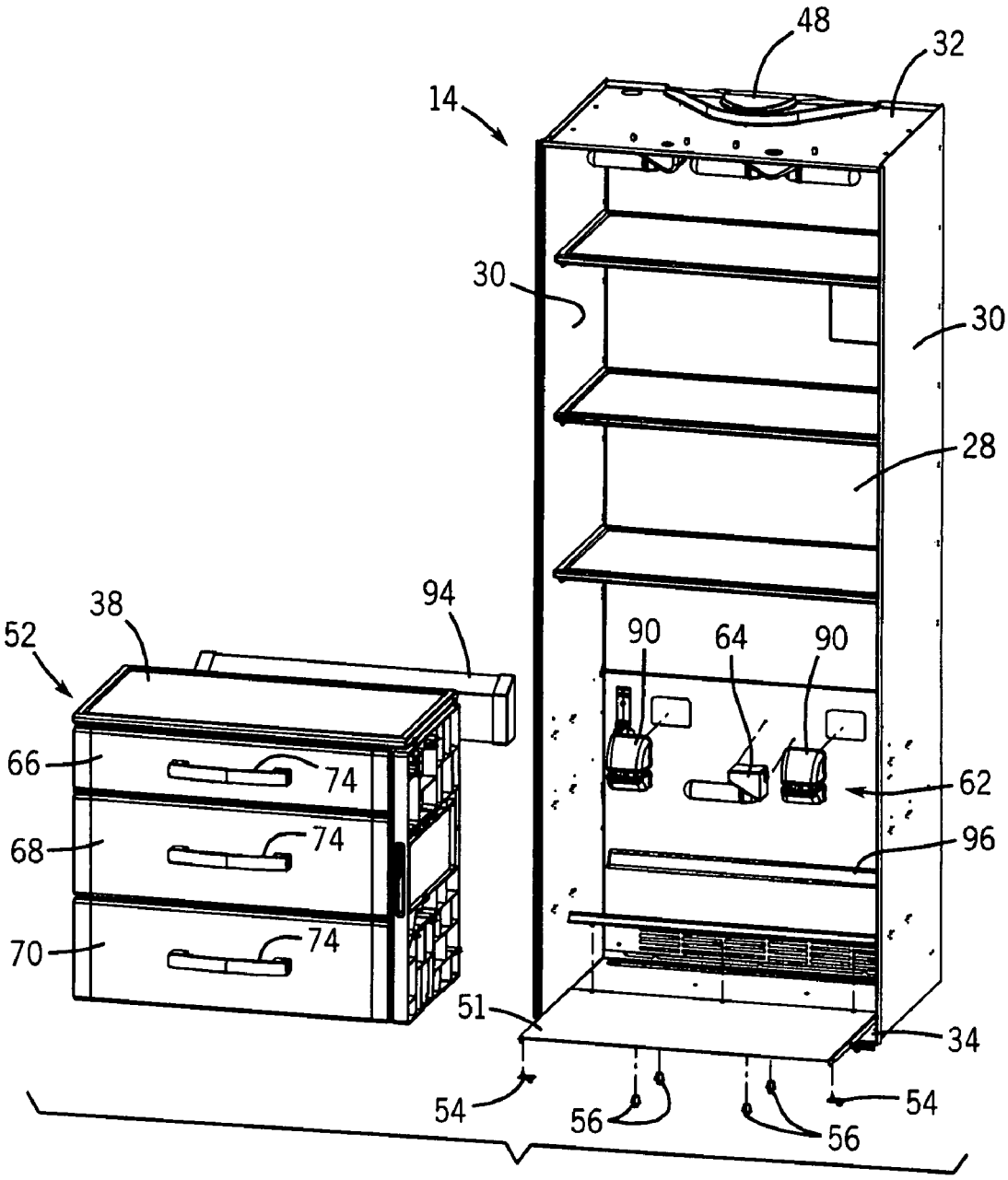
FIG. 2 is an exploded perspective view of a refrigerator compartment with a storage assembly for the refrigerator of FIG. 1.

FIGS. 1 and 2 show an appliance in the form of a refrigerator 10 according to an exemplary embodiment is shown. Refrigerator 10 is shown as a side-by-side style refrigerator having a body 12 (e.g., cabinet, housing, shell, etc.), a pair of refrigerated compartments (shown as a refrigerator compartment 14 and a freezer compartment 16), and refrigeration and air circulation systems for refrigerator compartment 14. According to a preferred embodiment, freezer compartment 16 also has refrigeration and air circulation systems separate from the refrigeration and air circulation systems for refrigerator compartment 14. Providing separate refrigeration and air circulation systems allows the compartments to be cooled independently and allows the freezer compartment to be cooled by cold, dry air, and the refrigerator compartment to be cooled by humid air that is at a higher temperature than the freezer compartment (e.g., for fresh foods).

Refrigerator 10 further includes a refrigerator door 20 and a freezer door 22, which are pivotally attached to refrigerator body 12 such that each may be moved between a closed position and a variety of open positions. Doors 20, 22 may include one or more storage shelves 24, 26 having varying heights and widths and being adjustable along the height of the doors. Shelves 24 extend across substantially the entire width of the doors; shelves 26 extend only partially across the width of the door to provide a variety of storage and functional options.

Further referring to FIG. 1, body 12 includes various wall portions. For example, refrigerator compartment 14 includes a back wall 28, opposing sidewalls 30, and top and bottom walls 32, 34. Body 12 also includes one or more intermediate walls, such as divider wall 36 that separates refrigerator compartment 14 and freezer compartment 16. According to the illustrated embodiment, one compartment is used for refrigeration (e.g., of fresh foods or the like) and the other compartment is used as a freezer. Alternatively, both compartments may be used for refrigeration purposes or as freezers. Refrigerator 10 also include one or more fixed shelves 38 or adjustable storage shelves 40, 42 located within compartments 14, 16 and positioned between divider wall 36 and sidewalls 30. Shelves 38, 40, 42 may be made of glass, coated or encapsulated wires, polymers, or the like.

Figure 3:
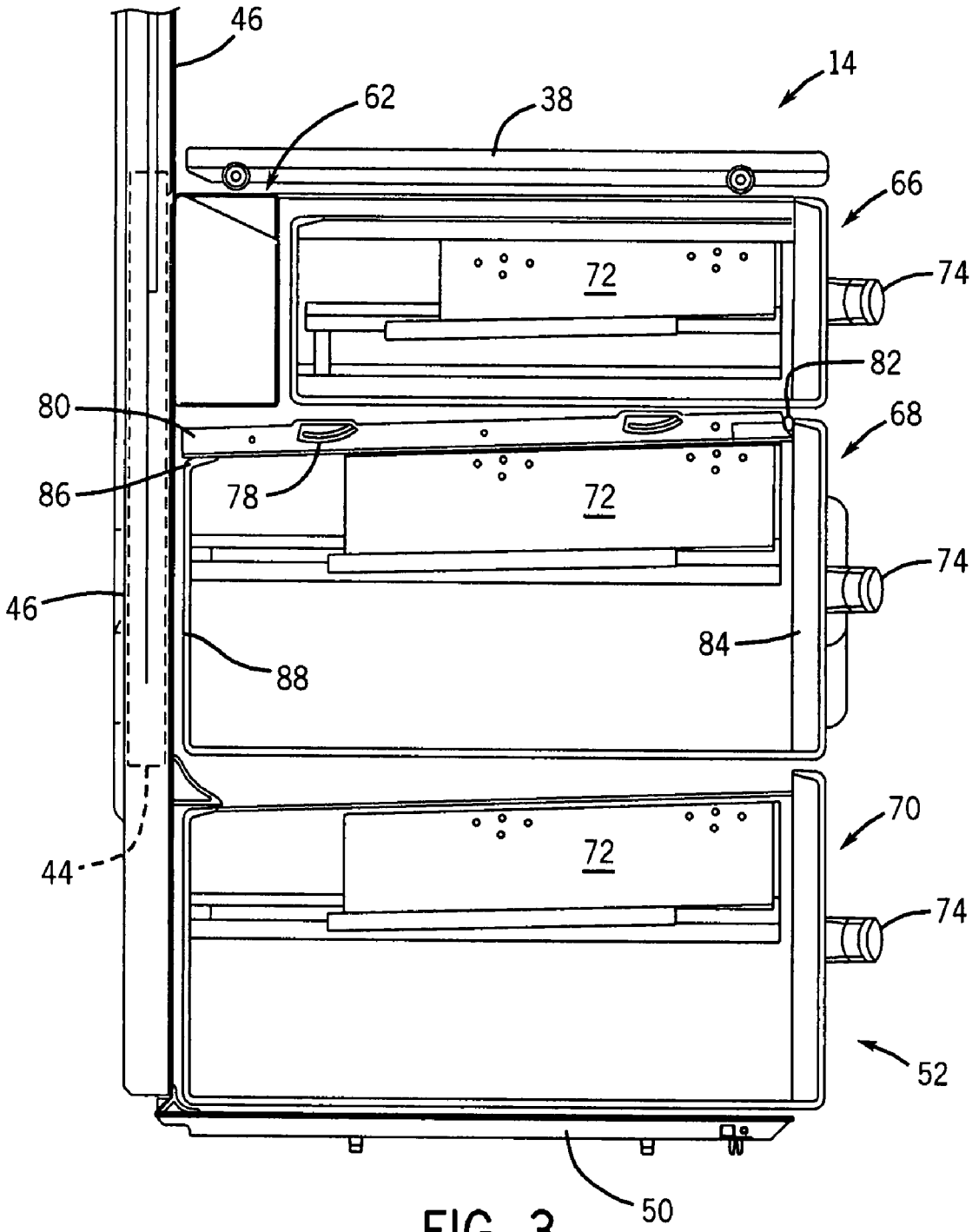
FIG. 3 is a side sectional view of the-storage compartment and air passageways.
Figure 5:
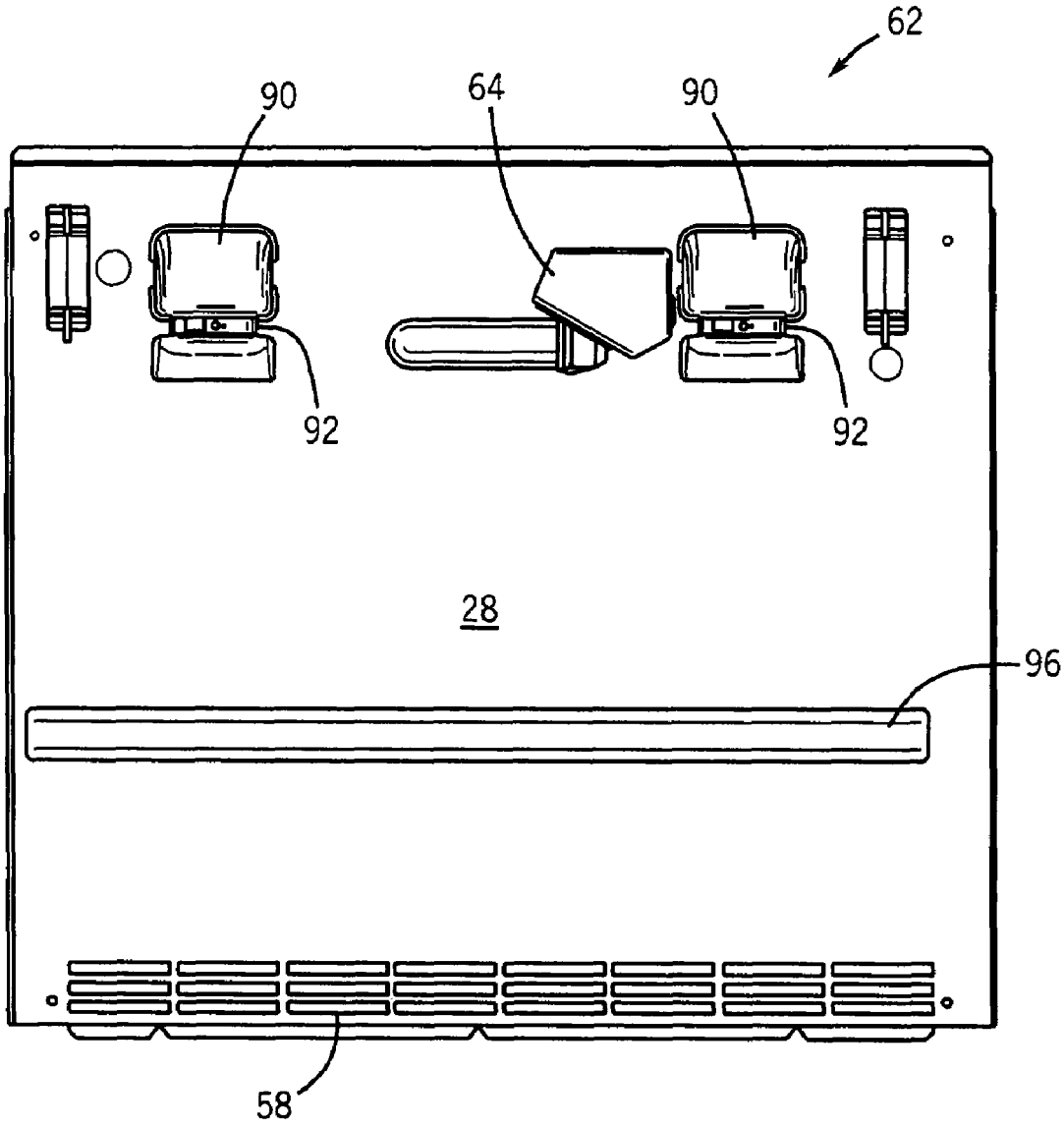
FIG. 5 is a front view of the air circulation system of FIG. 4.

Referring to FIGS. 2 and 3, the refrigeration system cools air and the air circulation system circulates the chilled air through refrigerator compartment 14. The refrigeration system includes a compressor, condenser, expansion valve, and an evaporator 44. The air circulation system includes structure that moves and guides air in the compartment, which is shown as a main or supply air duct 46 (e.g., passage, passageway, duct, conduit, etc.), a fan 48, and a return duct 50. Supply duct 46 extends along the back of refrigerator compartment 14 from about the bottom of the compartment to about the top, and is formed by a panel (e.g., member, plate, and is commonly referred to as the cold plate). Evaporator 44 is located in a lower portion of supply duct 46. Generally, the air is at its coldest temperature at or around evaporator 44. Fan 48 is mounted at the interface between supply duct 46 and refrigerator compartment 14. Fan 48 draws the chilled air, which is surrounding evaporator 44, through supply duct 46 and expels the chilled air into refrigerator compartment 14. Return duct 50 is located below a food storage assembly 52 and is configured to provide a passage for air to be returned to, and pass over, the evaporator to be chilled again. Return duct 50 spans substantially the entire width of refrigerator compartment 14 and is formed by a member or panel 51 coupled to walls of the compartment (e.g., the liner) by clips 54 and is supported along its interior by standoffs 56. According to a preferred embodiment as shown in FIG. 5, back wall 28 includes one or more slots 58 configured to also allow air to return to supply duct 46 (e.g., from the storage compartment). The air circulation system also includes a second fan (or set of fans) that draws air through a bypass duct for a "secondary" or "bypass" air circulation system described further below.

Referring to FIGS. 2-5, storage assembly 52 includes one or more storage compartments and a "secondary" or "bypass" air circulation system 62 configured to provide chilled air to, in, or around (e.g., directly or indirectly) the storage compartments so that the temperature therein is maintained at a lower temperature than the rest of the refrigerator compartment 14. According to a preferred embodiment, the chilled air provided to the storage compartments by system 62 is refrigerator compartment 14 air, rather than freezer compartment 16 air. Storage assembly 52 also includes a light 64 coupled to back wall 28 to illuminate the storage spaces therein.

Referring to FIGS. 2 and 3, the (food) storage compartments are shown as an upper drawer 66, a middle drawer 68, and a lower drawer 70. Drawers 66, 68, 70 (e.g., bin, basket, container, holder, etc.) are sometimes referred to as "crispers" and are slidably coupled to sidewalls by rails 72 (e.g., tracks, slides, glides, etc.). According to alternative embodiments, any of a variety of number of drawers and configurations may be provided—three drawers coupled to sidewalls are shown for illustration purposes. The drawers may be coupled to other support structures inside the compartment to shelves, or the like. According to a preferred embodiment, drawers 66, 68, 70 each includes a handle 74 and a plurality of walls or panels that form a cavity with an open top to provide access to the cavity when slid out from refrigerator compartment 14.

Upper drawer 66 is generally open to the refrigerated compartment 14 and is located just below fixed shelf 38. Preferably, fixed shelf 38 includes a transparent plate (e.g., glass or a clear polymer) so that the interior cavity of the upper drawer is visible.

Middle drawer 68 is located below upper drawer 66. Middle drawer 68 is separated from upper drawer 66 by a plate 78 coupled to sidewalls 30 by a pair of retaining channels 80. Plate 78 is preferably transparent (e.g., glass or a clear polymer). The interior cavity of middle drawer 68 is substantially, if not entirely, sealed from the chilled air flow by a gasket 82 mounted to a front edge of plate 78 that engages a front panel 84 of middle drawer 68 and a gasket 86 extending from a rear portion of plate 78 that engages a rear panel 88 of middle drawer 68.

Lower drawer 70 is generally open to the refrigerated compartment 14 and is located just below middle drawer 68.

Referring to FIGS. 2-5, the "secondary" or "bypass" air circulation system 62 is configured to provide chilled air to, in, or around (e.g., directly or indirectly) the storage compartments so that the temperature therein is maintained at a lower temperature than the rest of refrigerator compartment 14. The chilled air provided to the storage compartments is a lower temperature (e.g., 2 or more degrees Fahrenheit) than the chilled air entering refrigerator compartment 14 and circulating through refrigerator compartment 14 because the chilled air being provided to the storage compartments is taken from the space near the top of evaporator 44 and remainder of the chilled air undergoes heat losses (i.e., "gains") the further the chilled air is from evaporator 44. System 62 includes one or more "bleeder" or "bypass" ducts 90, one or more fans 92, a cover 94, and a baffle 96.

Referring to FIGS. 2 and 4-6, ducts 90 provide a conduit or passage for air to travel from supply duct 46 into storage assembly 52.

Referring to FIGS. 2 and 4-6, fans 92 draw a portion of the chilled air from supply duct 46 through an opening in the cold plate, and ducts 90 direct (e.g., guides, diverts, etc.) the portion of chilled air into storage assembly 52. This portion of the chilled air passes around and/or in through drawers 66, 68, 70 to provide direct or indirect cooling. According to an exemplary embodiment, fans 92 operate during the refrigerator compressor "on" cycle (i.e., when refrigeration and circulation system is operating). According to a particularly preferred embodiment, fans 92 are 12 Volt (V) DC fans mounted within duct 90. Alternatively, any of a variety of fans may be provided (e.g., quantity, powersource, capacity/power, etc.).

Figure 4:
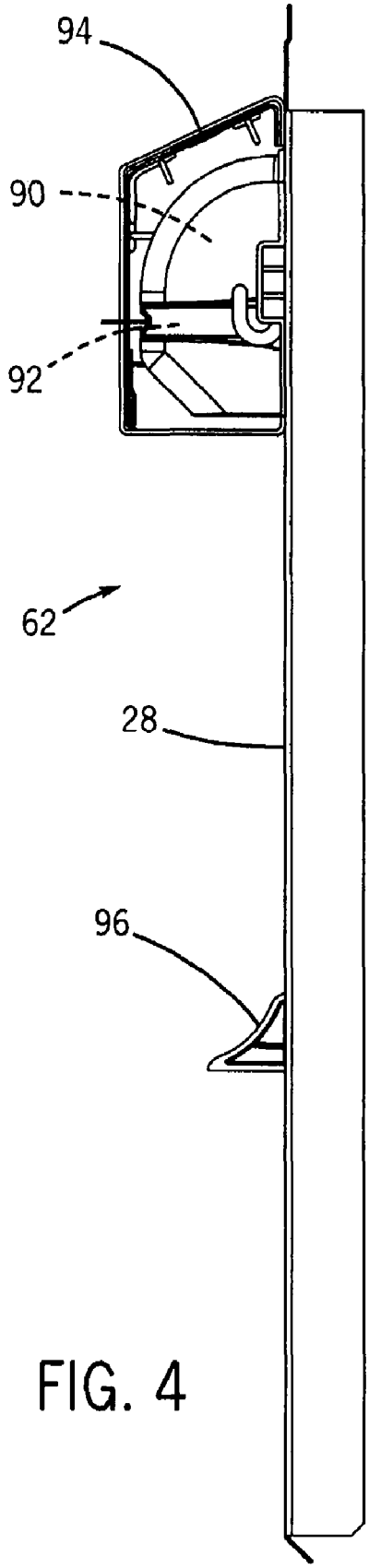
FIG. 4 is a side view of an air circulation system for the storage assembly of FIG. 3.

Referring to FIGS. 2-4, cover 94 encloses ducts 90, fans 92, and light 64. Baffle 96 (e.g., louver, etc.) directs or guides the chilled air away from back wall 28 (i.e., the cold plate) and into bottom drawer. Baffle 96 is coupled to back wall above lower drawer 70 and has a curved surface that engages air flowing along back wall 28. According to a preferred embodiment, the baffle is an integral formed component (e.g., molded polymer, shaped metal, etc.).

Figure 6:
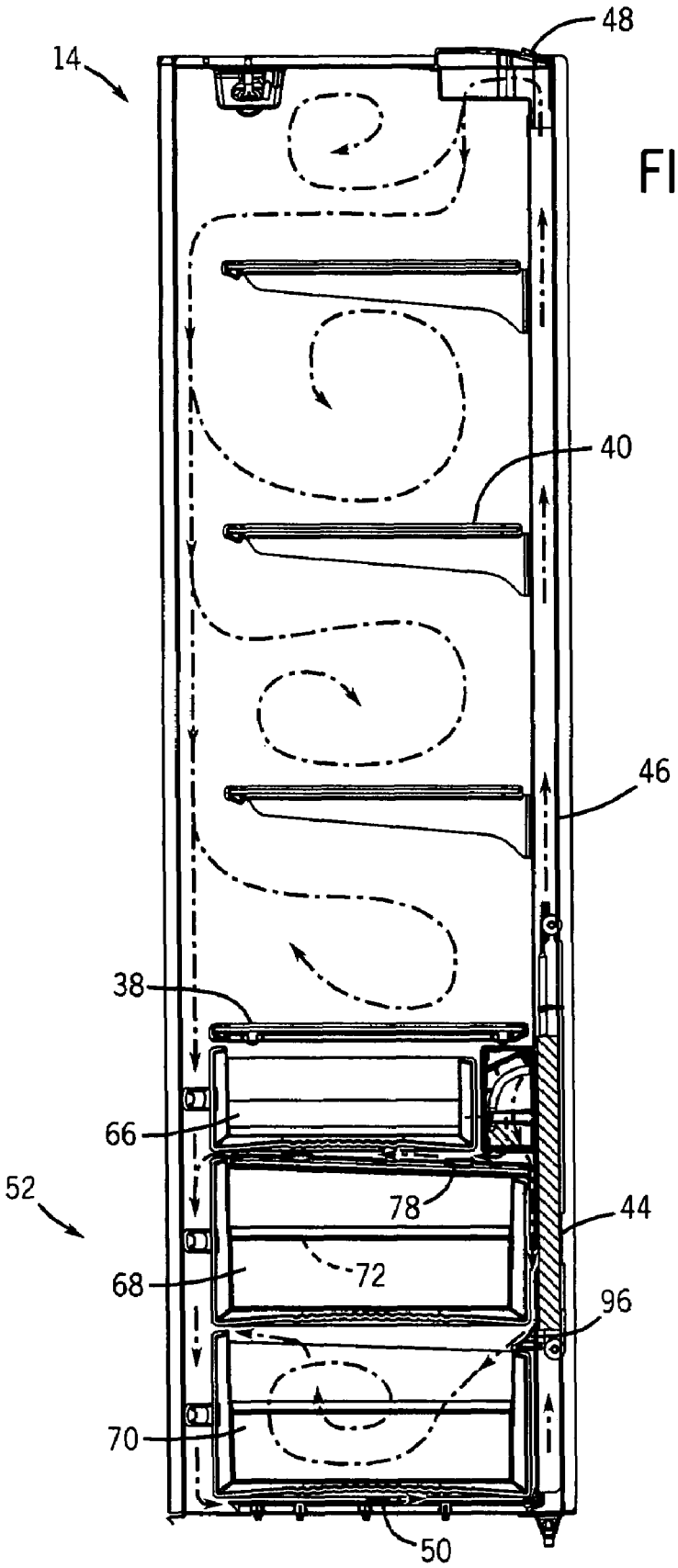
FIG. 6 is a side sectional view of the refrigerator compartment of FIG. 2 showing the air flow from the main air circulation system and the air circulation system for the storage assembly.

FIG. 6 is a side section view of refrigerator compartment 14 and includes arrows showing the air flow through refrigerator compartment 14 and Storage assembly 52. As illustrated by the airflow, the chilled air is divided as it leaves supply duct 46 and as chilled air leaves bypass ducts 90. Generally, chilled air from bypass ducts travel down to chill the middle drawer 68 and lower drawer 70 and forward (towards door 20) to chill top drawer 66 and middle drawer 68. Upper drawer 66 undergoes indirect cooling (i.e., the chilled air flow does not enter the interior cavity of drawer 66, rather the chilled air flows around the sides of drawer 66). Middle drawer 68 undergoes indirect cooling (i.e., the chilled air flow does not enter the interior cavity of drawer 68, rather the chilled air flows around the sides of drawer 68). Lower drawer 70 undergoes direct cooling (i.e., the chilled air flow enters the interior cavity of drawer 70) and indirect cooling (i.e., chilled air flowing around the sides of drawer 70). The air from bypass ducts 90 is returned to evaporator 44 through return duct 50 (under lower drawer 70) and through slots 58 (behind lower drawer 70).

It is important to note that for purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Such joining may also relate to mechanical, fluid, or electrical relationship between the two components.

It is also important to note that the construction and arrangement of the elements of the refrigerator chilled food storage area as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, it should be understood that the embodiments and teachings disclosed herein with respect to only one of compartments extend to both of compartments according to various alternative embodiments. According to various alternative embodiments, the refrigerator may be a "top-bottom" style refrigerator, a "chest" style refrigerator, and so on. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. An appliance comprising:

a refrigerated compartment;

a first drawer located in the refrigerated compartment and open to airflow from the refrigerated compartment;

a second drawer located in the refrigerated compartment below the first drawer and movable between an open position and a closed position, the second drawer is closed to airflow from the refrigerated compartment when in the closed position;

a refrigeration and circulation system comprising:

a main air duct extending substantially the length of the refrigerated compartment;

an evaporator to cool air in the main air duct located and adjacent the first drawer and second drawer;

a secondary air duct in communication with the chilled air in the main air duct;

a first fan configured to circulate air between the main air duct and the refrigerated compartment;

a second fan is configured to move air through the secondary air duct;

wherein a portion of the chilled air is supplied directly from the evaporator to the refrigerated compartment through the secondary duct between the first drawer and the second drawer and between the second drawer and the main duct, and the remainder of the air cooled by the evaporator is supplied to the refrigerated compartment away from the first drawer.

2. The appliance of claim 1, wherein the first fan is located in the main air duct near an outlet to the refrigerated compartment, and the second fan is located in the secondary air duct adjacent the evaporator.

3. The appliance of claim 1 wherein the first drawer and the second drawer undergo indirect cooling by the air flowing through the secondary air duct.

4. The appliance of claim 3 further comprising a third drawer located below the second drawer and configured to undergo direct cooling by the portion of chilled air flowing through the secondary air duct.

5. The appliance of claim 1 further comprising a baffle configured to guide at least a portion of the portion of chilled air into at least one of the drawers.

6. The appliance of claim 1 further comprising a return duct located below the second drawer and configured to provide a passage between the refrigerated compartment and the main air duct.

7. The appliance of claim 6 further comprising a plurality of slots located on the main air duct behind the second drawer.

8. The appliance of claim 1 wherein the refrigerated compartment is configured to store fresh foods.

9. The appliance of claim 1, wherein the evaporator is at least partially located in the main air duct.

10. The appliance of claim 9 wherein the second fan is coupled to the secondary air duct and configured to draw the portion of the chilled air from the main air duct adjacent the evaporator.

11. The appliance of claim 1, wherein the circulation system comprises a return duct at least partially located below the first drawer and second drawer and configured to allow air to flow from the refrigerated compartment into the main air duct below the evaporator.

12. The appliance of claim 1, wherein the evaporator is located substantially adjacent the secondary air duct.

13. The appliance of claim 1, further comprising a third drawer located below the second drawer; wherein the first drawer and the second drawer undergo indirect cooling by the portion of chilled air circulated by the second fan, and the third drawer undergoes direct cooling by the portion of chilled air circulated by the second fan.

14. The appliance of claim 13 wherein the first drawer is open to airflow from the refrigerated compartment, the second drawer is sealed from airflow from the refrigerated compartment, and the third drawer is open to airflow from the refrigerated compartment.

15. The appliance of claim 14 further comprising a freezer compartment having a refrigeration system and an air circulation system separate from the refrigeration system and circulation system of the refrigerated compartment.

16. The appliance of claim 1 wherein the second fan is coupled to the secondary air duct.

17. The appliance of claim 16 wherein the evaporator is located substantially inside the main air duct and adjacent the first drawer, the second drawer, and the secondary air duct.

18. The appliance of claim 17 wherein the evaporator is located at a lower portion of the main air duct.

19. The appliance of claim 17 further comprising a third drawer located below the second drawer; wherein the first drawer and the second drawer undergo indirect cooling by the portion of chilled air circulated by the second fan, and the third drawer undergoes direct cooling by the portion of chilled air circulated by the second fan.

20. The appliance of claim 19 further comprising a baffle configured to guide at least a portion of the air flow from the second fan into the third drawer.

21. The appliance of claim 1 wherein the refrigerated compartment is one of a refrigerator compartment or a freezer compartment.

* * * * *

UNITED STATES PATENT AND TRADEMARK OFFICE

CERTIFICATE OF CORRECTION

PATENT NO. : 7,665,327 B2
APPLICATION NO. : 11/654218
DATED : February 23, 2010
INVENTOR(S) : Scott T. Tunzi It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 390 days.

Signed and Sealed this

Seventh Day of December, 2010

David J. Kappos

David J. Kappos
*Director of the United States Patent and Trademark Office*